US005881439A

United States Patent [19]

Ellis et al.

[11] Patent Number: 5,881,439

[45] Date of Patent: Mar. 16, 1999

[54] BASE AND HOUSING FOR SEAT BELT BUCKLE

[75] Inventors: Robert P. Ellis, Almont; Robert J. Desmarais, Lake Orion, both of Mich.

[73] Assignee: TRW Vehicle Safety Systems Inc., Lyndhurst, Ohio

[21] Appl. No.: 918,542

[22] Filed: Aug. 22, 1997

[51] Int. Cl.[6] ..... A44B 11/26

[52] U.S. Cl. ..... 24/633; 24/642

[58] Field of Search ..... 24/633, 636–642

[56] References Cited

U.S. PATENT DOCUMENTS

| | | | |
|---|---|---|---|
| 4,624,035 | 11/1986 | Wier | 24/633 X |
| 5,067,212 | 11/1991 | Ellis . | |
| 5,377,393 | 1/1995 | Ellis . | |
| 5,381,590 | 1/1995 | Liou et al. | 24/633 X |

*Primary Examiner*—James R. Drittain
*Attorney, Agent, or Firm*—Tarolli, Sundheim, Covell, Tummino & Szabo

[57] ABSTRACT

An apparatus (10) includes a base (30) defining a passage (32) which receives a seat belt tongue (16). The base (30) has an intermediate portion (108) between a pair of opposite end portions (106 and 112). The apparatus (10) further includes a housing (28) which contains the base (30). The housing (28) and the end portions (106 and 112) of the base (30) have structures (100, 128, 132) that interlock following movement of the base (30) within the housing (28) in a first direction and subsequently in a second, opposite direction. One of the housing (28) and the intermediate portion (108) of the base (30) defines a slot (144). The other of the housing (28) and the intermediate portion (108) of the base (30) defines a tab (102) which moves into abutment with a surface (146) in the slot (144) upon movement of the base (30) in the second direction.

9 Claims, 4 Drawing Sheets

BASE AND HOUSING FOR SEAT BELT BUCKLE

FIELD OF THE INVENTION

The present invention relates to a buckle for a seat belt locking tongue. The present invention particularly relates to a buckle having a base which receives the tongue, and further having a housing which contains the base.

BACKGROUND OF THE INVENTION

A seat belt system for restraining a vehicle occupant typically includes seat belt webbing, a seat belt locking tongue on the webbing, and a seat belt buckle. The tongue on the webbing is inserted in the buckle when the webbing has been placed about a vehicle occupant. A latch mechanism in the buckle interlocks with the tongue to secure the webbing about the occupant.

In addition to the latch mechanism, the buckle typically includes a base and a housing. The base supports the latch mechanism, and defines a passage in which the tongue is received upon insertion in the buckle. The housing contains and conceals the base and the latch mechanism from view.

For example, U.S. Pat. No. 5,377,393 discloses a seat belt buckle with a housing containing a base and a latch mechanism. When the buckle disclosed in the '393 patent is being assembled, the latch mechanism is first mounted on the base. The latch mechanism and the base are then received together in the housing. Specifically, the base (with the latch mechanism attached) is moved fully into the housing. The base is subsequently moved a short distance in a direction extending back outward of the housing. When the base is moved within the housing in this manner, a pair of tabs on a front end portion of the base are received in a pair of slots in a front end portion of the housing. Another pair of tabs on a rear end portion of the base are then deflected forcefully into a corresponding pair of slots in a rear end portion of the housing. This interlocks the base with the housing.

SUMMARY OF THE INVENTION

In accordance with the present invention, an apparatus comprises a base and a housing which contains the base. The base defines a passage which receives a seat belt tongue, and has an intermediate portion between a pair of opposite end portions. The housing and the end portions of the base include structures that interlock following movement of the base within the housing. Such movement of the base includes movement in a first direction and subsequently in a second, opposite direction.

The housing and the intermediate portion of the base define a slot and a tab. The slot is preferably formed in the housing, with the tab being located on the intermediate portion of the base. However, the slot could alternatively be formed in the intermediate portion of the base, with the tab being located on the housing. In either case, the tab moves into abutment with a surface in the slot upon movement of the base in the second direction.

In a preferred embodiment of the present invention, the tab and the slot are elongated in the first and second directions. The slot is longer than the tab by an amount not less than the distance through which the base moves in the second direction upon interlocking with the housing. The slot in the preferred embodiment is one of a plurality of slots which are spaced apart in a row parallel to the first and second directions. The tab in the preferred embodiment is one of a corresponding row of tabs receivable in the slots.

BRIEF DESCRIPTION OF THE DRAWINGS

The foregoing and other features of the present invention will become more apparent upon reading the following description in view of the accompanying drawings, wherein.

DESCRIPTION OF A PREFERRED EMBODIMENT

Figure 1:
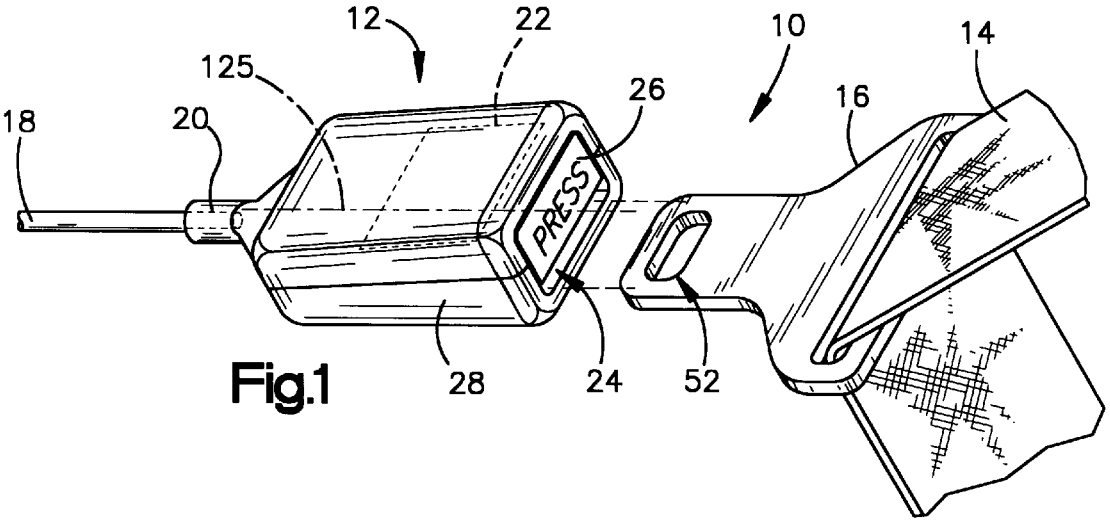
FIG.1 is an isometric view of a vehicle occupant restraint apparatus comprising a preferred embodiment of the present invention.

A vehicle occupant restraint apparatus 10 comprising a preferred embodiment of the present invention is shown partially in FIG. 1. The apparatus 10 includes a seat belt buckle 12, seat belt webbing 14, and a seat belt tongue 16 on the webbing 14. The buckle 12 is anchored in a vehicle in a known manner, such as by a cable 18 connected to a stem 20 which projects from the buckle 12. A cover (not shown) may be used to conceal the cable 18 and the stem 20 in a known manner. A latch mechanism 22 (shown schematically) locks the tongue 16 in the buckle 12 when the tongue 16 is moved into an opening 24 at the end of the buckle 12. The tongue 16 is subsequently released from the buckle 12 upon depression of a pushbutton 26 adjacent to the opening 24.

Figure 2:
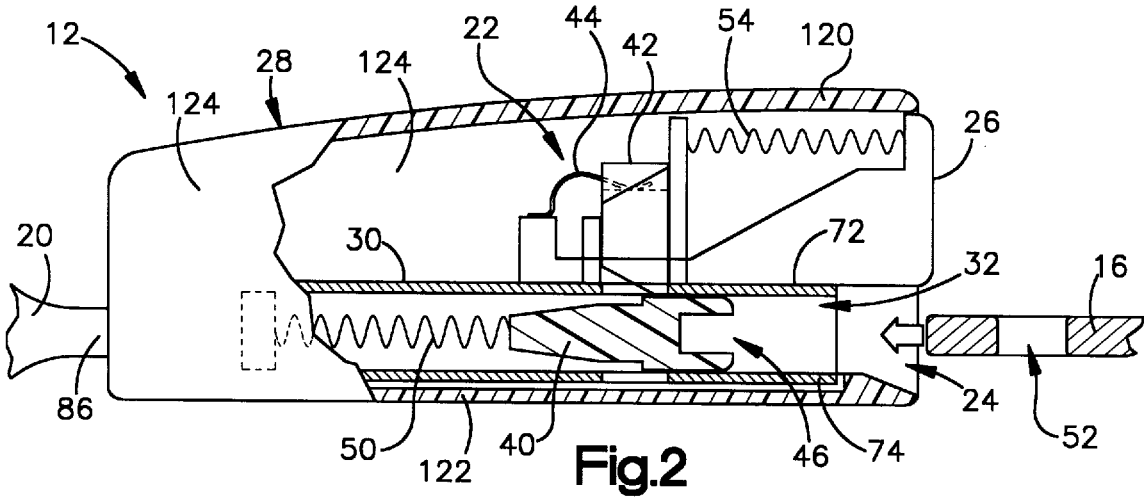
FIG. 2 is a side view, partly in section, of parts of the apparatus of FIG. 1, with certain parts being shown schematically.
Figure 3:
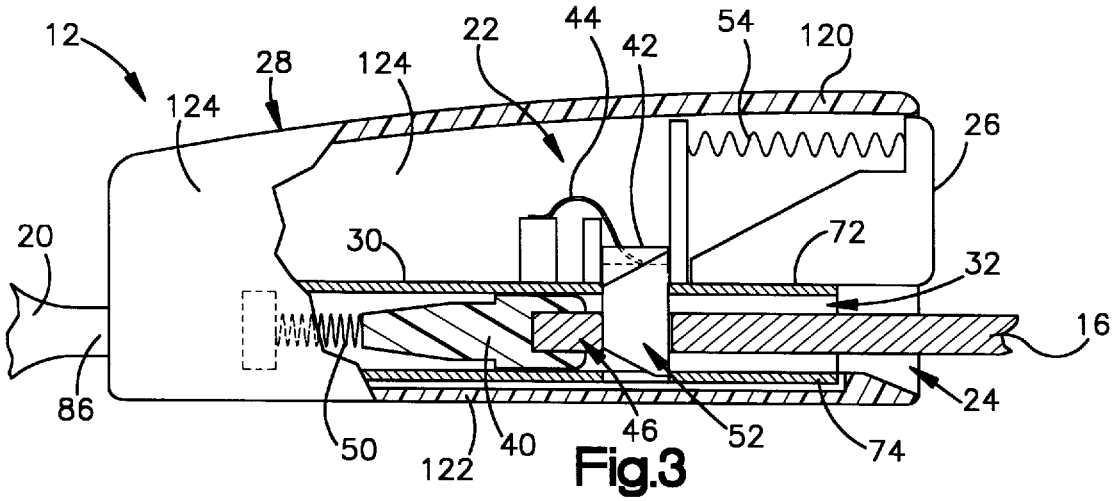
FIGS. 3 and 4 are views similar to FIG. 2 showing parts in different positions.
Figure 4:
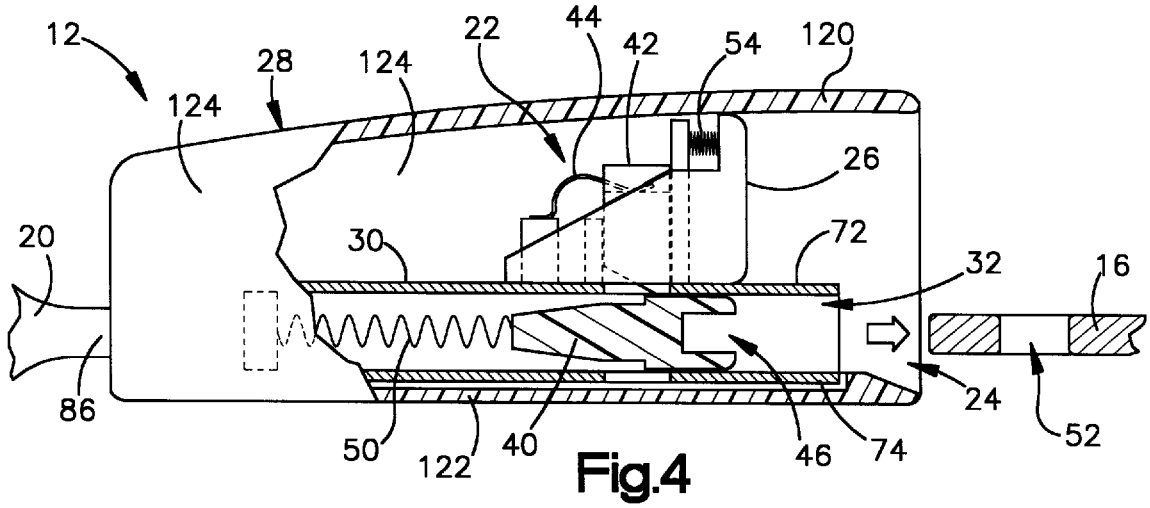

The buckle 12 includes a housing 28. The latch mechanism 22 is contained in the housing 28, and may comprise any suitable structure capable of releasably interlocking with the tongue 16 in cooperation with the pushbutton 26. The buckle 12 further includes a base 30 (FIGS. 2–4). The base 30 supports the latch mechanism 22 in the housing 28, and defines a passage 32 which receives the tongue 16.

As shown by way of example in FIGS. 2–4, the latch mechanism 22 in the preferred embodiment of the present invention is substantially the same as the latch mechanism shown in U.S. Pat. No. 5,377,393, noted above. The latch mechanism 22 thus has a plurality of known parts including the pushbutton 26, an ejector 40 and a latch 42.

The latch 42, which is sometimes referred to as a locking bar, locking element, or the like, is movable between a non-locking position (FIG. 2) and a locking position (FIG. 3). When the tongue 16 is located outside the buckle 12, as shown in FIG. 2, the ejector 40 holds the latch 42 in the non-locking position against the bias of a latch spring 44.

The tongue 16 is inserted through the opening 24, as indicated by the arrow shown in FIG. 2, and is moved into engagement with the ejector 40 in a notch 46 at the end of the ejector 40. The tongue 16 is then moved inward against the ejector 40 so as to push the ejector 40 along the passage 32 from a forward position (FIG. 2) to a rearward position (FIG. 3) against the bias of an ejector spring 50.

As the tongue 16 and the ejector 40 approach the positions of FIG. 3, an aperture 52 in the tongue 16 moves into alignment with the latch 42. The latch spring 44 then moves the latch 42 to the locking position through the aperture 52 in the tongue 16 so that the latch 42 blocks removal of the tongue 16 from the buckle 12.

When the tongue 16 is to be released from the buckle 12, the pushbutton 26 is moved inward to the position of FIG. 4 against the bias of a pushbutton spring 54. The pushbutton 26 engages, or may be linked with, the latch 42 in a known manner so as to move the latch 42 back out of the aperture 52 in the tongue 16 against the bias of the latch spring 44. The ejector spring 50 then moves the ejector 40 back outward along the passage 32 toward the opening 24 to eject the tongue 16 from the buckle 12.

Figure 5:
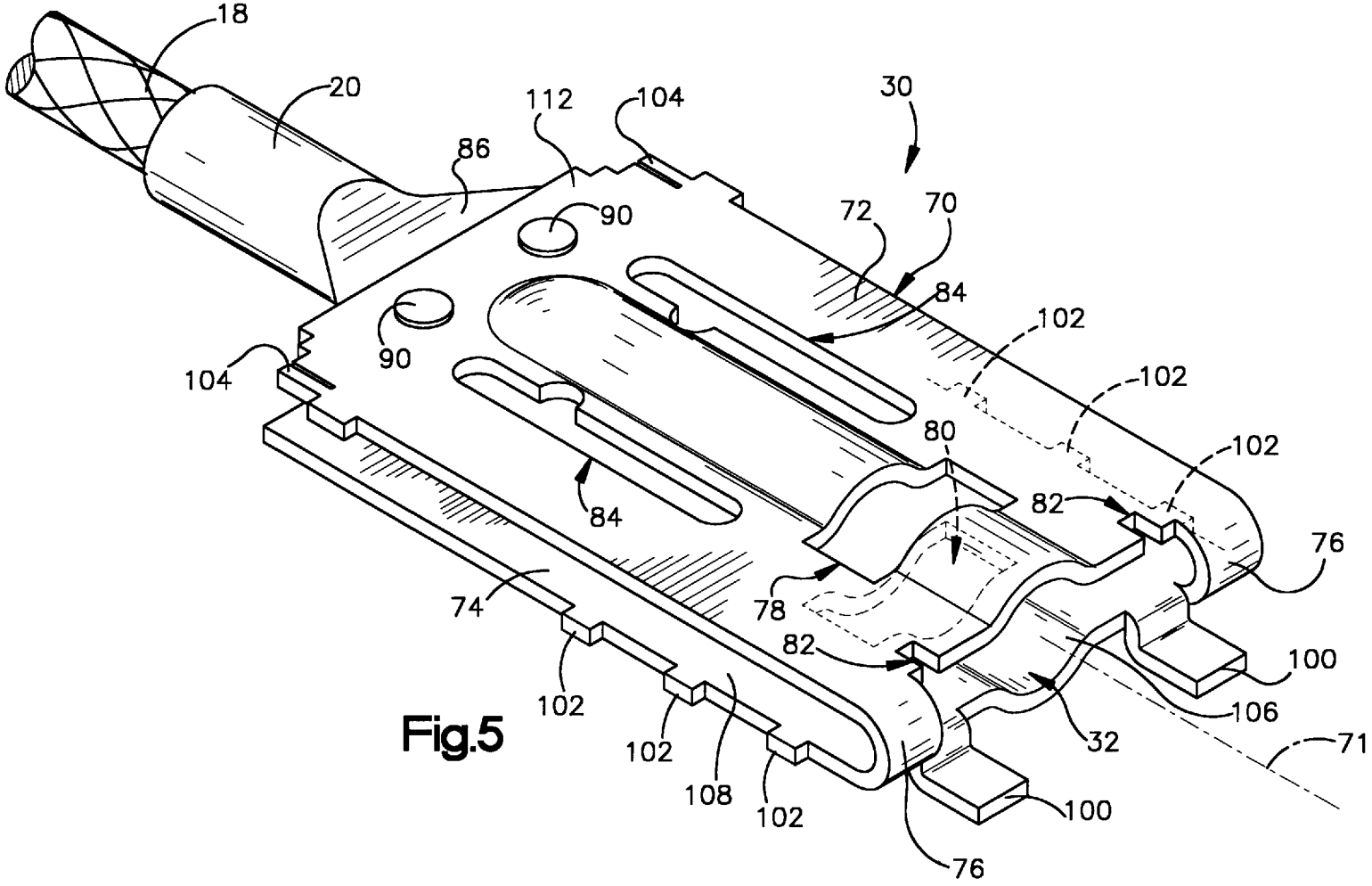
FIG. 5 is an isometric view of a part shown in FIGS. 2–4.

As shown in greater detail in FIG. 5, the base 30 in the preferred embodiment of the present invention is similar to the base shown in U.S. Pat. No. 5,377,393. The base 30 is formed from an elongated metal part 70 having a longitudinal centerline 71 and a pair of generally rectangular wall portions 72 and 74. The wall portions 72 and 74 are joined by a pair of narrow connector portions 76. The metal part 70 is folded about the connector portions 76 such that the wall portions 72 and 74 are brought toward each other to define upper and lower walls of the base 30. The walls 70 and 72 of the base 30 are spaced apart to define the passage 32 which receives the tongue 16.

The walls 72 and 74 of the base 30 further define a pair of aligned apertures 78 and 80, respectively, through which the latch 42 moves into and out of engagement with the tongue 16 in the passage 32. A pair of notches 82 and a pair of slots 84 in the upper wall 72 receive corresponding mounting portions (not shown) of the latch mechanism 22 that support the latch mechanism 22 on the base 30, as known in the art. A flattened portion 86 of the stem 20 is received between the walls 72 and 74 of the base 30. A pair of rivets 90 fasten the stem 20 to the base 30.

The base 30 has tabs that engage the housing 28 to retain the base 30 in an installed position in the housing 28. These include a pair of first tabs 100, two groups of second tabs 102, and a pair of third tabs 104.

The first tabs 100 are located on opposite sides of the centerline 71, and project from a front end portion 106 of the lower wall 74 in directions parallel to the centerline 71. The second tabs 102 project from an intermediate portion 108 of the lower wall 74 in directions perpendicular to the centerline 71. Although the second tabs 102 preferably are equally spaced in two rows of three which are located directly opposite each other across the base 30, as shown in FIG. 5, they could have any other suitable arrangement. The third tabs 104 are located at the corners of the upper wall 72 at a rear end portion 112 of the upper wall 72.

The housing 28 is an elongated structure which is slightly longer than the base 30. Although the housing 28 could have several parts, it preferably is a unitary part consisting of a single continuous body of injection molded plastic material with an upper wall 120, a lower wall 122, and a pair of opposite side walls 124. The housing 28 has a longitudinal centerline 125, as shown in FIG. 1, and is bi-laterally symmetrical across the centerline 125.

The lower wall 122 of the housing 28 has a raised front end portion 126. The raised front end portion 126 defines a pair of first slots 128 for receiving the first tabs 100 on the base 30. The first slots 128, one of which is shown in FIGS. 6–8 and 9, are located on opposite sides of the centerline 125, and are alike. Accordingly, the first slots 128 have equal depths D (FIG. 9) extending in directions parallel to the centerline 125. A pair of inner housing walls 130 on opposite sides of the centerline 125 define a respective pair of third slots 132 for receiving the third tabs 104 on the base 30.

The housing 28 further has a pair of internal support ledges 140, one of which also is shown in FIGS. 6–8 and 9. The support ledges 140 are located on opposite sides of the centerline 125. Each support ledge 140 extends along the juncture of the lower wall 122 and a corresponding side wall 124. A narrow upper portion 142 (FIG. 9) of each support ledge 140 defines a longitudinally extending row of three spaced-apart slots 144. In this arrangement, the two support ledges 140 define two parallel rows of second slots 144 for receiving the second tabs 102 on the base 30.

The second slots 144 have front ends defined by surfaces 146 that are perpendicular to the centerline 125 of the housing 28. A wide lower portion 148 of each support ledge 140 has a planar upper surface 150 that is perpendicular to the surfaces 146 at the front ends of the slots 144. The planar upper surfaces 150 define the bottoms of the slots 144, and extend from the slots 144 along the lengths of the support ledges 140. A planar upper surface 152 of each support ledge 140 is interrupted along its length by each of the slots 140. The upper surface 152 slopes downward, as viewed in FIGS. 6–9, from the raised front end portion 126 of the lower wall 122.

Figure 6:
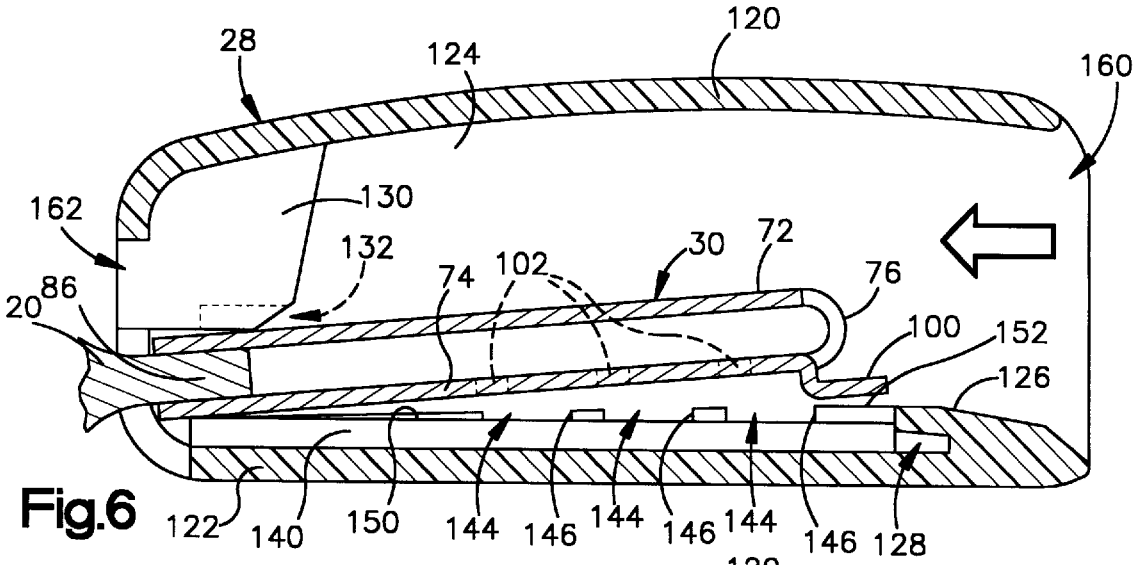
FIG. 6 also is a side view, partly in section, of parts of the apparatus of FIG. 1.
Figure 7:
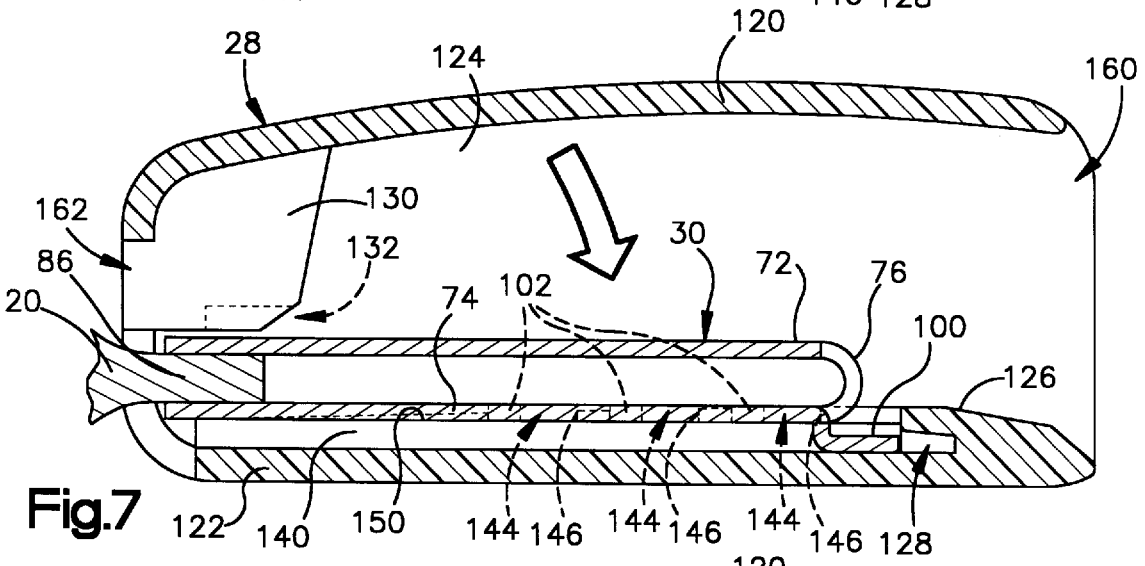
FIGS. 7 and 8 are views similar to FIG. 6 showing parts in different positions.
Figure 8:
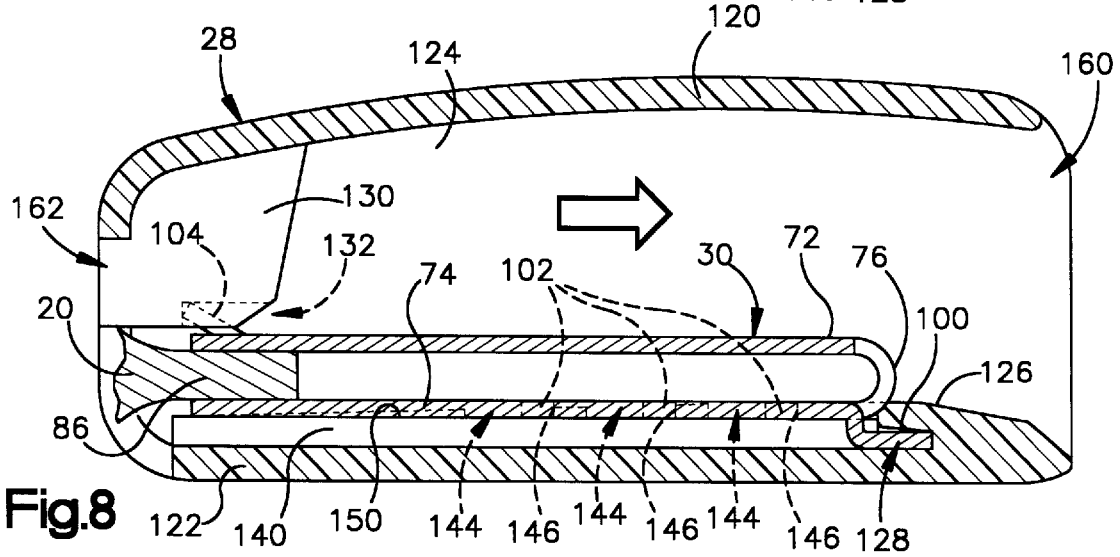

When the buckle 12 is being assembled, the latch mechanism 22 is mounted on the base 30 at a location outside the housing 28. The latch mechanism 22 and the base 30 are then received together in the housing 28. As shown in FIGS. 6–8, the base 30 is moved to an installed position in which it is interlocked with the housing 28. The latch mechanism 22 is omitted from FIGS. 6–8 for clarity of illustration.

The base 30 is first received longitudinally through an open front end 160 of the housing 28. As indicated by the arrow shown in FIG. 6, the base 30 is moved into the housing 28 in a first direction parallel to the centerline 125 of the housing 28. The base 30 is then tilted slightly to enable the stem 20 to be moved outward through an open rear end 162 of the housing 28. The first tabs 100 at the front of the base 30 slide inward over the raised front end portion 126 of the housing 28 as the stem 20 moves outward through the open rear end 162 of the housing 28.

Next, the base 30 is moved downward toward the lower wall 122 of the housing 26, as indicated by the arrow shown in FIG. 7. The base 30 is moved in this manner until the lower wall 74 of the base 30 moves against the planar upper surfaces 150 on the support ledges 140. The second tabs 102, which project from the lower wall 74, are simultaneously moved downward into the second slots 144 in the support ledges 140.

The base 30 is next moved in a second, outwardly extending direction parallel to the centerline 125, as indicated by the arrow shown in FIG. 8. The first tabs 100 on the base 30 are simultaneously moved fully into the first slots 128 in the housing 28. The base 30 is thus moved forward through a distance at least as great as the depth D (FIG. 9) of the first slots 128.

Finally, the third tabs 104 are deflected upwardly into the third slots 132, as shown in FIG. 8, to interlock the base 30 with the housing 28. The third tabs 104 forcefully engage and deform the plastic material of the housing 28 within the third slots 132 in the manner described in U.S. Pat. No. 5,377,393. This develops a longitudinally directed force which tightens the interlock between the base 30 and the housing 28 by pressing the ends of the first and third tabs 100 and 104 firmly into abutment with the housing 28 in the first and third slots 128 and 132, respectively.

Figure 9:
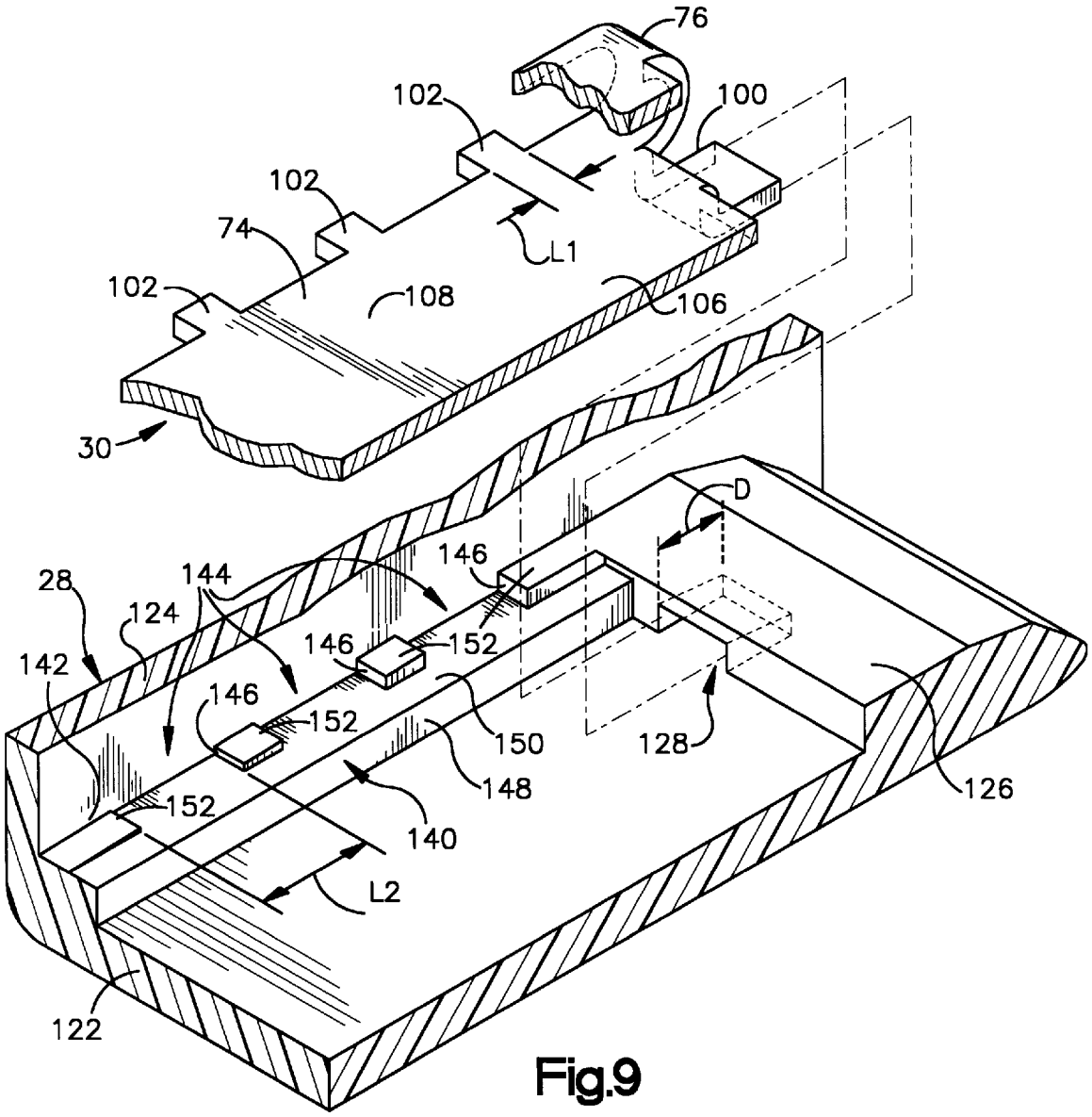
FIG. 9 is an enlarged, isometric partial view of parts shown in FIGS. 6–8.

The second tabs 102 move into abutment with the surfaces 146 at the front ends of the second slots 144 when the base 30 is moved forward to the installed position of FIG. 8. This increases the total surface area of the base 30 that abuts the housing 28 under the longitudinally directed force developed by the tight fit of the third tabs 104 in the third slots 132. In accordance with this feature of the present invention, the second tabs 102 are elongated in a direction parallel to the centerline 71 of the base 30, and each has a length L1 (FIG. 9). The second slots 144 are elongated in a direction parallel to the centerline 125 of the housing 28, and each has a length L2. Since the second tabs 102 are moved downward into the second slots 144 before the first tabs 100 are moved forward into the first slots 128, the second tabs 102 must be able to move forward in the second slots 144 through a distance at least as great as the depth D. Therefore, the length L2 exceeds the length L1 by an amount at least as great as the depth D.

From the above description of the invention, those skilled in the art will perceive improvements, changes and modifications. Such improvements, changes and modifications within the skill of the art are intended to be covered by the appended claims.

Having described the invention, the following is claimed:

1. Apparatus comprising:

a base defining a passage which receives a seat belt tongue, said base having an intermediate portion between a pair of opposite end portions; and a housing which contains said base, said housing and said end portions of said base including structures that interlock following movement of said base within said housing, said movement including movement in a first direction and subsequently in a second, opposite direction;

one of said housing and said intermediate portion of said base defining a slot, the other of said housing and said intermediate portion of said base defining a tab which moves into abutment with a surface in said slot upon said movement of said base in said second direction.

2. Apparatus as defined in claim 1 wherein said slot is larger in said first and second directions than said tab by a predetermined amount, said predetermined amount being at least as great as the distance through which said base moves in said second direction upon interlocking with said housing.

3. Apparatus as defined in claim 2 wherein said slot is one of a row of slots, said tab being one of a row of tabs receivable in said row of slots.

4. Apparatus as defined in claim 3 wherein said base and said housing have centerlines, said row of slots being one of a pair of rows of slots on opposite sides of said centerlines, said row of tabs being one of a pair of rows of tabs receivable in said rows of slots.

5. Apparatus as defined in claim 4 wherein said slots are defined by said housing and said tabs are defined by said base.

6. Apparatus comprising:

a base defining a passage which receives a seat belt tongue, said base having first and second tabs projecting in directions that are perpendicular to each other; and a housing defining first and second slots in which said first and second tabs move into abutment with said housing upon movement of said base to an installed position in said housing, said movement including movement that occurs in a direction and through a distance determined by said first tab and said first slot;

said second slot being larger in said direction than said second tab by a predetermined amount, said predetermined amount being at least as great as said distance.

7. Apparatus as defined in claim 6 wherein said housing consists of a single continuous body of molded plastic material.

8. Apparatus as defined in claim 6 wherein said second slot is one of a row of second slots, said second tab being one of a row of second tabs receivable in said row of second slots.

9. Apparatus as defined in claim 8 wherein said housing has a centerline, said row of second slots being one of a pair of rows of second slots on opposite sides of said centerline, said row of second tabs being one of a pair of rows of second tabs receivable in said rows of second slots.

* * * * *